US009328565B1

(12) United States Patent
Cannon

(10) Patent No.: US 9,328,565 B1
(45) Date of Patent: May 3, 2016

(54) DIAMOND-ENHANCED CARBIDE CUTTING ELEMENTS, DRILL BITS USING THE SAME, AND METHODS OF MANUFACTURING THE SAME

(71) Applicant: US Synthetic Corporation, Orem, UT (US)

(72) Inventor: Randy S Cannon, Springville, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 526 days.

(21) Appl. No.: 13/799,990

(22) Filed: Mar. 13, 2013

(51) Int. Cl.
*E21B 10/56* (2006.01)
*B22F 3/14* (2006.01)
*E21B 10/567* (2006.01)

(52) U.S. Cl.
CPC ..... *E21B 10/567* (2013.01)

(58) Field of Classification Search
CPC ..... E21B 10/46; E21B 10/52; E21B 10/56; E21B 10/5673; E21B 10/5676; B22F 3/12; B22F 3/1208; B22F 3/14
USPC ..... 175/434, 433; 51/309; 76/108.4, 108.2; 419/28, 38, 56
See application file for complete search history.

(56) References Cited

U.S. PATENT DOCUMENTS 4,171,339 A * 10/1979 Lee ..... B01J 3/062 264/332
4,604,106 A 8/1986 Hall et al.
4,694,918 A * 9/1987 Hall ..... B22F 7/06 175/414
5,304,342 A * 4/1994 Hall, Jr. ..... B01J 3/062 419/11
5,833,021 A * 11/1998 Mensa-Wilmot ..... E21B 10/567 175/433
6,196,340 B1 * 3/2001 Jensen ..... E21B 10/52 175/431
6,290,008 B1 * 9/2001 Portwood ..... E21B 10/5676 175/420.1
6,709,737 B2 * 3/2004 Rigali ..... C08K 3/34 428/210
6,779,951 B1 * 8/2004 Vale ..... B22F 7/06 407/119
6,845,828 B2 1/2005 Boyce
7,264,879 B2 9/2007 Sue et al.
7,588,102 B2 * 9/2009 Hall ..... E21B 10/5673 175/425
7,647,992 B2 1/2010 Fang et al.
7,681,669 B2 3/2010 Cannon et al.
7,842,111 B1 * 11/2010 Sani ..... F16C 33/26 175/374
7,951,455 B2 * 5/2011 Weis ..... B01J 19/02 175/374
8,020,644 B2 * 9/2011 Keshavan ..... B22F 7/06 175/433
8,191,658 B2 * 6/2012 Schmitz ..... B24D 99/005 175/420.2
8,202,335 B2 * 6/2012 Cooley ..... B24D 3/10 175/426
8,236,074 B1 8/2012 Bertagnolli et al.
8,728,382 B2 * 5/2014 Hall et al. ..... C04B 35/52 264/604
2009/0272583 A1 * 11/2009 Pope ..... E21B 10/567 175/430
2010/0236836 A1 * 9/2010 Voronin ..... B22F 7/04 175/426
2011/0258937 A1 * 10/2011 Qian et al. ..... B24D 3/10 51/297
2012/0055716 A1 * 3/2012 Martensson ..... C22C 26/00 175/428
2012/0325562 A1 12/2012 Scott et al.
2013/0000992 A1 * 1/2013 DiGiovanni ..... B22F 7/064 175/432
2014/0034396 A1 * 2/2014 Zhang ..... B22F 7/062 175/428

* cited by examiner

*Primary Examiner* — Kenneth L Thompson
(74) *Attorney, Agent, or Firm* — Dorsey & Whitney LLP

(57) ABSTRACT

Embodiments for diamond-enhanced carbide cutting elements and drilling apparatuses that include a diamond-enhanced carbide material are disclosed. Embodiments of methods for manufacturing such articles are also disclosed. The diamond-enhanced carbide cutting elements disclosed are at least partially enclosed by a refractory metal structure from a refractory metal can assembly used in the fabrication of the diamond-enhanced carbide cutting element. The diamond-enhanced carbide cutting elements disclosed herein have greater abrasion resistance than tungsten carbide, and a greater toughness than polycrystalline diamond cutters.

25 Claims, 6 Drawing Sheets

DIAMOND-ENHANCED CARBIDE CUTTING ELEMENTS, DRILL BITS USING THE SAME, AND METHODS OF MANUFACTURING THE SAME

BACKGROUND

Drill bits are frequently used in the oil and gas exploration, drilling water wells, construction, quarries, geothermal mining, and other recovery industries to drill well bores (also referred to as "boreholes") in subterranean earth formations. There are two common classifications of drill bits used in drilling well bores that are known as "fixed-blade" drill bits and "roller cone" drill bits. Fixed-blade drill bits typically include polycrystalline diamond compact ("PDC") cutting elements that are inserted in to the body of the bit. These drill bits typically include a bit body having an externally threaded connection at one end for connection to a drill string, and a plurality of cutting blades extending from the opposite end of the bit body on which the PDC cutting elements are mounted. These PDC cutting elements are used to cut through the subterranean formation during drilling operations when the drill bit is rotated by a motor or other rotational input device.

The other type of earth boring drill bit, referred to as a roller cone bit, typically includes a bit body with an externally threaded connection at one end, and a plurality of roller cones (typically three) attached at an offset angle to the other end of the drill bit. These roller cones are able to rotate individually with respect to the bit body.

Tungsten carbide inserts or buttons are commonly used as "teeth" on roller cone and hammer/percussion drill bits. In some applications, PDC inserts are used instead of tungsten carbide inserts in order to improve abrasive wear resistance.

SUMMARY

Embodiments of the invention relate to cutting elements that include a diamond-enhanced carbide ("DEC") material and drilling apparatuses that may employ such cutting elements. Methods for manufacturing such cutting elements are also disclosed. Surprisingly and unexpectedly, the inventor has observed improved damage resistance for a cutting element in which only a portion of a refractory metal can assembly used in the fabrication of the cutting element is removed or a cutting element in which the refractory metal can assembly is substantially removed via an abrasive blasting process.

In an embodiment, a cutting element is disclosed. The cutting element includes a substrate having a proximal portion and a distal portion. A sintered DEC layer is bonded to at least the distal portion of the substrate. A refractory metal structure is bonded to at least part of the DEC layer. At least a portion of the substrate forms an exterior surface of the cutting element that is not covered by the refractory metal structure.

In another embodiment, a drilling apparatus (e.g., a roller cone or a percussion drill bit) is disclosed. The drilling apparatus includes a bit body and one or more DEC cutting elements attached to the bit body. The one or more DEC cutting elements include a substrate having a proximal portion and a distal portion, a sintered DEC layer bonded to the distal portion of the substrate, and a refractory metal structure bonded to at least part of the DEC layer. At least a portion of the substrate forms an exterior surface of the one or more DEC cutting elements that is not covered by the refractory metal structure.

In yet another embodiment, a method of making a cutting element is disclosed. The method includes providing a substrate having a proximal portion and a distal portion. A volume of a carbide powder (e.g., discrete cobalt-cemented tungsten carbide particles) intermixed with a plurality of diamond particles is positioned adjacent to the distal portion of the substrate. The substrate and the volume of the carbide powder/diamond particles is at least partially surrounded within a refractory metal can assembly. The refractory metal can assembly containing the substrate and the volume of the carbide powder/diamond particles is then exposed to a high-pressure/high-temperature ("HPHT") process to form a sintered DEC layer that is bonded to at least the distal portion of the substrate, with the refractory metal can assembly being bonded to the DEC layer and the substrate. In an embodiment, a portion of the refractory metal can assembly may be removed such that at least a portion of the refractory metal can assembly remains bonded to at least part of the DEC layer. In another embodiment, the refractory metal can assembly may be blasted with an abrasive media to remove substantially all of the refractory metal can assembly from the substrate and the DEC layer.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Embodiments of the invention relate to cutting elements and drilling apparatuses that include a DEC material. Methods for manufacturing such cutting elements are also disclosed. The DEC material disclosed herein may have greater abrasion resistance than tungsten carbide, greater toughness than PDC, and cost between tungsten carbide and PDC. The DEC material disclosed herein is well suited for use on drill bit inserts, teeth, or buttons. Surprisingly and unexpectedly, the inventor has observed improved damage resistance for a cutting element in which only a portion of a refractory metal can assembly used in the fabrication of the cutting element is removed or a cutting element in which the refractory metal can assembly is substantially removed via an aggressive abrasive blasting process.

Figure 1:
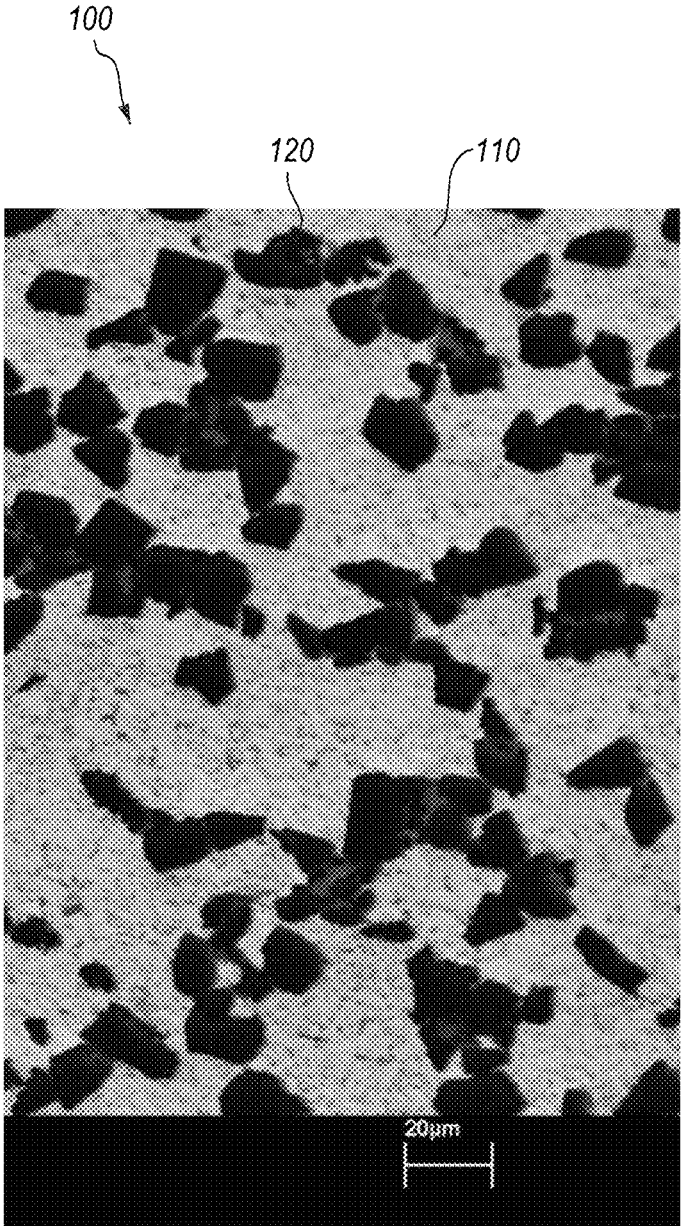
FIG. 1 is a photomicrograph of a microstructure of a DEC material according to an embodiment.

FIG. 1 is a photomicrograph of a microstructure of a DEC material 100 according to an embodiment. The DEC material 100 includes a plurality of diamond grains 120 distributed in a cemented tungsten carbide constituent 110. For example, the cemented tungsten carbide 110 constituent includes tungsten carbide grains cemented together with a cementing constituent, such as cobalt, iron, nickel, or alloys thereof. As illustrated, depending on the volume fraction of the diamond grains 120, there may be fairly limited diamond-to-diamond $sp^3$ bonding between the diamond grains 120 and the diamond grains 120 may be distributed in a substantially continuous matrix of the cemented tungsten carbide constituent 110.

In an embodiment, the cemented tungsten carbide constituent 110 includes about 5 weight % ("wt %") to about 13 wt % cobalt (e.g., about 5 wt % to about 13 wt %, about 6 wt % to about 13 wt %, or about 11 wt % to about 13 wt %) and about 80 wt % to about 85 wt % tungsten carbide grains (e.g., about 82 to about 83 wt %). In an embodiment, the DEC material 100 includes about 10 volume % ("vol %") to about 90 vol % diamond grains 120, about 20 vol % to about 50 vol % diamond grains 120, or about 25 vol % to about 35 vol % (e.g., about 30 vol %) diamond grains 120, with the balance being substantially the tungsten carbide constituent 110. In an embodiment, the diamond grains 120 and/or the tungsten carbide grains of the tungsten carbide constituent 110 may each have an average grain size in a range from about 2 μm to about 50 μm, such as about 10 μm to about 25 μm, about 2 μm to about 4 μm (e.g., about 3 μm), about 15 μm to about 25 μm, about 20 μm to about 40 μm about 18 μm to about 22 μm, or about 10 μm to about 15 μm.

In an embodiment, the DEC material 100 may be made by mixing diamond powder with a carbide powder (e.g., discrete cobalt-cemented tungsten carbide particles ("WC—Co") and/or a mixture of carbide powder and a metal (e.g., tungsten carbide and cobalt, iron, nickel, or alloys thereof)) to form a mixture. In an embodiment, such carbide materials may be commonly referred to as Spray Fuse and Powder Welding powders (e.g., such carbide powders comprising tungsten carbide and cobalt). Spray Fuse and Powder Welding powders are commercially available from Kennametal Incorporated and may be identified, for example, by the following designations: K8, K9, K11, KS-12, KS-12LC, KS-15, KS-H, K0100, K0120, K3060, K3060R, K3070, K3076, K3109, K3404, K3406, K3411, K3520, K3560, K3833, K3030B, K3030C, K3045, K3047, K3055, or K3055C.

The mixture is then subjected to an HPHT process to cement/sinter the powder into a solid mass. As shown in the photomicrograph of FIG. 1, the resulting material includes the solid tungsten carbide constituent 110 having a number of the diamond grains 120 embedded therein. As will be explained in greater detail below, the DEC material 100 material may be sintered and attached to a substrate (e.g., a tungsten carbide substrate) during the HPHT process.

The DEC material 100 disclosed herein is more abrasion resistant than a pure cemented carbide material and it is tougher (i.e., more crack resistant) than sintered polycrystalline diamond ("PCD"). It is currently believed by the inventor that the inclusion of diamond grains increases the abrasion resistance. Likewise, it is currently believed by the inventor that the DEC materials disclosed herein are tougher than PCD because of the relatively tougher tungsten carbide constituent 110.

Figure 2A:
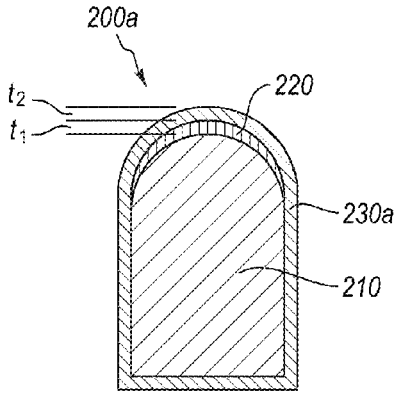
FIG. 2A is a cross-sectional view of a DEC cutting element substantially surrounded by a refractory metal can assembly according to an embodiment.

Referring now to FIG. 2A, a cross-sectional view of a DEC cutting element 200*a* substantially surrounded by a refractory metal can assembly 230*a* is illustrated. The DEC cutting element 200*a* includes a substrate 210 with a DEC layer 220 coated on one end (i.e., the distal end) of the substrate 210. For example, the substrate 210 may comprise a cobalt-cemented tungsten carbide substrate. Other materials for the substrate 210 include, without limitation, cemented carbides including titanium carbide, niobium carbide, tantalum carbide, vanadium carbide, and combinations of any of the preceding carbides cemented with iron, nickel, cobalt, or alloys thereof.

In the illustrated embodiment, the substrate 210 has a domed hemispherical end and the DEC layer 220 is coated on the domed hemispherical end in a thin layer on the distal end of the substrate 210. However, it should be noted that in other embodiments, the substrate 210 may have a flat interfacial surface and the DEC layer 220 may exhibit a relatively thicker hemispherical geometry. In an embodiment, the DEC layer 220 has a maximum thickness $t_1$ in a range of about 0.020 inch to about 0.080 inch, or about 0.0275 inch to about 0.070 inch (e.g., about 0.0275 inch to about 0.040 inch, about 0.050 inch to about 0.060 inch, or about 0.0590 inch). In an embodiment, the DEC layer 220 may have a substantially uniform thickness. In such an embodiment, the substrate 210 may include a lipped edge such that there may be a smooth transition between the DEC layer 220 and the substrate 210. In another embodiment as illustrated in FIGS. 2A-2F, the DEC layer 220 may be thickest at a distal-most end of the substrate 210 and the thickness of the DEC layer 220 may taper proximally away therefrom such that there may be a smooth transition between the DEC layer 220 and the substrate 210.

In the embodiment illustrated in FIG. 2A, the DEC cutting element 200*a* is substantially surrounded by the refractory metal can assembly 230*a*. As will be explained in greater detail below, the DEC cutting element 200*a* may be fabricated by mixing diamond powder with carbide powder, and positioning a volume of the carbide/diamond powder in a refractory metal can assembly with the substrate. The assembly may then be subjected to an HPHT process to HPHT cement/sinter the powder into a solid mass and to bond this solid mass onto the substrate 210 as the DEC layer 220. Although the refractory metal can assembly 230*a* is shown as a single piece, it should be understood that it may include two or more components, such as a bottom receptacle and a can top.

The refractory metal can assembly 230*a* has a thickness $t_2$. In an embodiment, the thickness $t_2$ may be in a range of about 0.0030 inch to about 0.010 inch, about 0.0010 inch to about 0.015 inch, 0.0030 inch to about 0.0060 inch (e.g., two cans having respective can thicknesses of 0.0030 inch to about 0.0060 inch). In any of the embodiments disclosed herein, the refractory metal can assemblies or refractory metal structures (e.g., refractory metal assembly 230) may be fabricated from a refractory metal selected from the group of niobium (Nb), tantalum (Ta), molybdenum (Mo), rhenium (Re), titanium (Ti), zirconium (Zr), alloys thereof, composites thereof, and combinations thereof. For example, in an embodiment, the refractory metal can assembly 230 is fabricated from niobium or a niobium-based alloy.

As previously discussed, surprisingly and unexpectedly, the inventor has observed improved damage resistance for the DEC cutting element 200*a* in which only a portion of a refractory metal can assembly 230*a* used in the fabrication of the DEC cutting element 200*a* is removed or in which the refractory metal can assembly 230*a* is substantially removed via an abrasive blasting process.

Figure 2B:
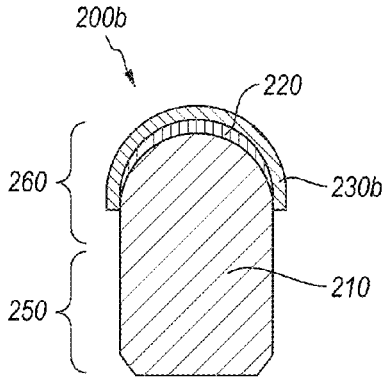
FIG. 2B is a cross-sectional view of a DEC cutting element having a portion of the refractory metal can assembly removed according to an embodiment.
Figure 2C:
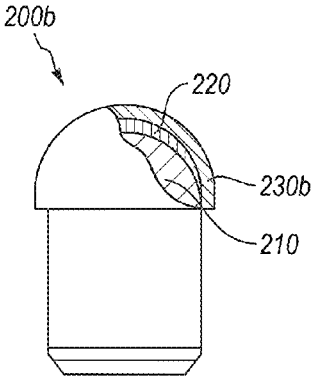
FIG. 2C is a side elevation, partial cutaway view of the DEC cutting element of FIG. 2B.

Referring now to FIGS. 2B-2F, various embodiments of DEC cutting elements are illustrated. FIG. 2B is a cross-sectional view of a DEC cutting element 200*b* shown in FIG. 2A except that a portion of the refractory metal can assembly has been removed. FIG. 2C is a side elevation, partial cutaway view of the DEC cutting element 200*b* of FIG. 2B. In the embodiment illustrated in FIGS. 2B and 2C, a portion of the refractory metal can assembly 230*a* has been removed from the side wall portions and the proximal end 250 of the substrate 210. This leaves a portion of the refractory metal can assembly 230*b* bonded to the DEC layer 220 and/or the distal portion 260 of the substrate 210, which is referred to herein sometimes as a refractory metal structure.

Figure 2D:
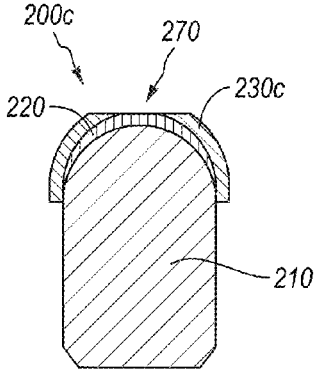
FIG. 2D is a cross-sectional view of another DEC cutting element having a portion of the refractory metal can assembly removed according to an embodiment.
Figure 2E:
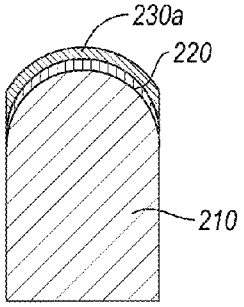
FIG. 2E is a cross-sectional view of the DEC cutting element shown in FIG. 2A after centerless grinding a periphery thereof to substantially remove the refractory metal can assembly from a side of the substrate according to an embodiment.
Figure 2F:
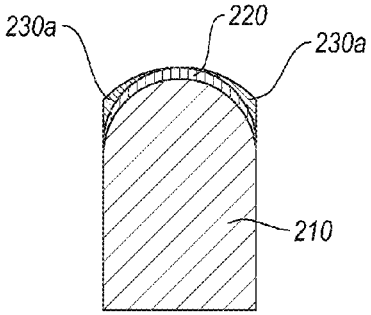
FIG. 2F is a cross-sectional view of the DEC cutting element shown in FIG. 2E after abrasive blasting the top of the DEC cutting element to remove a portion of the remaining refractory metal can assembly and expose a portion of the DEC layer according to an embodiment.

FIG. 2D is a cross-sectional view of another DEC cutting element 200*c* according to another embodiment. FIG. 2D illustrates an embodiment in which a portion of the refractory metal can assembly 230*c* has been removed proximate to tip region 270 of the DEC cutting element 200*c* to expose a portion of the underlying DEC layer 220. Optionally, the sides and bottom of substrate 210 may be exposed by removing a portion of the refractory metal can assembly 230*c*. FIG. 2E is a cross-sectional view of the DEC cutting element 200*a* shown in FIG. 2A after centerless grinding a periphery thereof to substantially remove the refractory metal can assembly 230*a* from a side of the substrate according to an embodiment. FIG. 2F is a cross-sectional view of the DEC cutting element shown in FIG. 2E after abrasive blasting of a top of the DEC cutting element 200*a* to remove a portion of the remaining refractory metal can assembly 230*a* and expose a portion of the DEC layer 220 according to an embodiment.

In an embodiment, the portions of the refractory metal can assembly that are removed may be removed by abrasive blasting (e.g., blasting with silicon carbide and/or alumina particles), abrasive grinding, machining (e.g., electro-discharge machining ("EDM")), or combinations thereof. In the field, the remaining portion or portions of the refractory metal can assembly (i.e., the refractory metal structure or cap) will wear through during drilling a subterranean formation, thereby exposing the underlying DEC layer as the working/cutting surface. Surprisingly and unexpectedly, the inventor has observed improved damage resistance associated with only removing a portion of the refractory metal can assembly as opposed to grinding/polishing/machining to remove substantially all of the refractory metal can assembly and has also observed improved damage resistance associated with removing substantially all of the refractory metal can assembly via an abrasive blasting process.

Referring now to FIGS. 3A-3E various views of different embodiments of DEC cutting elements are shown. Differently shaped cutters may be used depending on factors such as the hardness of the material to be drilled, the relative angle(s) between cutting elements in a tool, the number of cutting elements in a tool, the spacing between cutting elements in a tool, and the like.

Figure 3A:
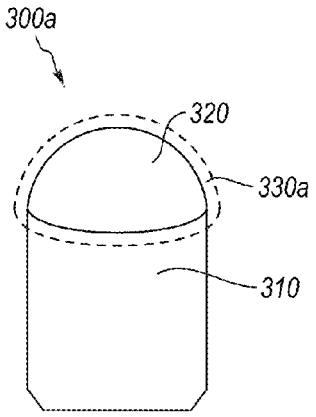
FIG. 3A is a side elevation view of a DEC cutting element having a domed cutting portion and a refractory metal structure covering at least the domed cutting portion according to an embodiment.

FIG. 3A is a side elevation view of a DEC cutting element 300*a* having a domed cutting portion 320 and having a refractory metal structure 330*a* covering at least the cutting portion 320 of the DEC cutting element 300*a*. Rounded cutters like that shown in FIG. 3A may, for example, be used for subterranean drilling in hard formations. Spacing between cutters like 300*a* in such a tool may be relatively narrow. The refractory metal structure 330*a* may increase the durability of the cutting element 300*a*.

Figure 3B:
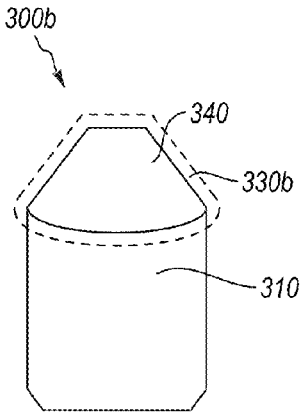
FIG. 3B is a side elevation view of a DEC cutting element having an angled cutting portion and a refractory metal structure covering at least the angled cutting portion according to an embodiment.
Figure 3C:
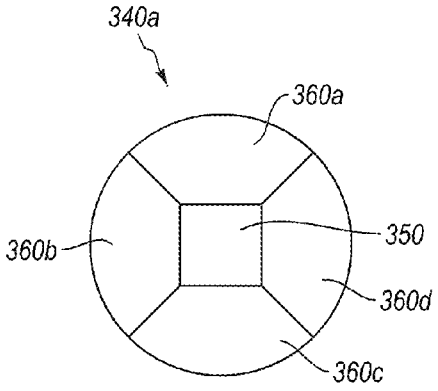
FIG. 3C is a top view of the DEC cutting element of FIG. 3B.
Figure 3D:
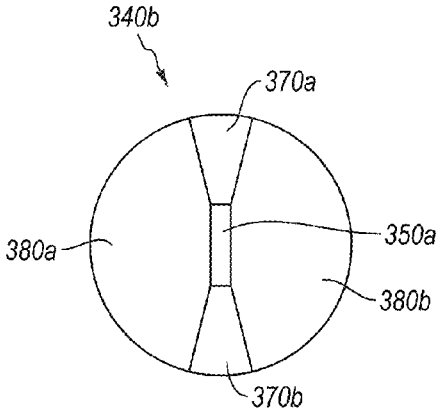
FIG. 3D is a top view of another embodiment of an angled cutting portion that may be included in the DEC cutting element of FIG. 3B according to an embodiment.

Referring now to FIGS. 3B-3D, an angled cutter 300*b* and a number of different embodiments for cutter head designs 340*a*, and 340*b* are illustrated. FIG. 3B is a side elevation view of a DEC cutting element 300*b* according to an embodiment. FIG. 3C is a top view of an embodiment of an angled cutting portion 340*a* that may be included in the DEC cutting element of FIG. 3B. Such angled cutters may be used in softer formations with wider cutter spacing on a tool. The DEC cutting element 300*b* includes a refractory metal structure 330*b* covering at least a portion of the angled cutting portion 340*a* of the DEC cutting element 300*b*.

FIGS. 3C and 3D are top views of embodiments of an angled cutting portion 340*a* and 340*b* that may be included in the DEC cutting element of FIG. 3B. Referring to FIG. 3C, the angled cutter 340*a* includes a relatively large and flat top surface 350 and four substantially symmetrical side faces 360*a*-360*d*. FIG. 3D shows another cutter design with a relatively small and narrow top surface 350*a* and two small corresponding side faces 370*a* and 370*b* and two larger side face 380*a* and 380*b* from which the side faces 370*a* and 370*b* extend. Because such cutting surfaces create relatively sharp angled faces, such angled cutters as are shown in FIGS. 3B-3D may be typically used in softer formations with wider cutter spacing on a tool.

Figure 3E:
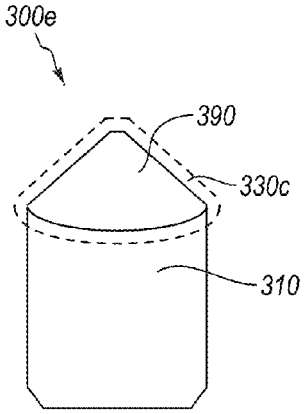
FIG. 3E is a side elevation view of a DEC cutting element having a pointed cutting portion and a refractory metal structure covering at least the pointed cutting portion according to an embodiment.

Referring now to FIG. 3E, a side elevation view of another embodiment of DEC cutting element 300*e* having a substantially pointed cutting portion 390 is illustrated. The cutting element 300*e* includes a refractory metal structure 330*c* covering at least the cutting portion 390 of the DEC cutting element 300*e*. Such a cutter with a relatively sharp cutting head 390 may be appropriate for drilling relatively softer material.

However, it should be noted that the cutter shapes shown in FIGS. 3A-3E are shown for illustration purposes only. Other cutter head shapes are contemplated and are within the scope of the present disclosure.

Figure 4A:
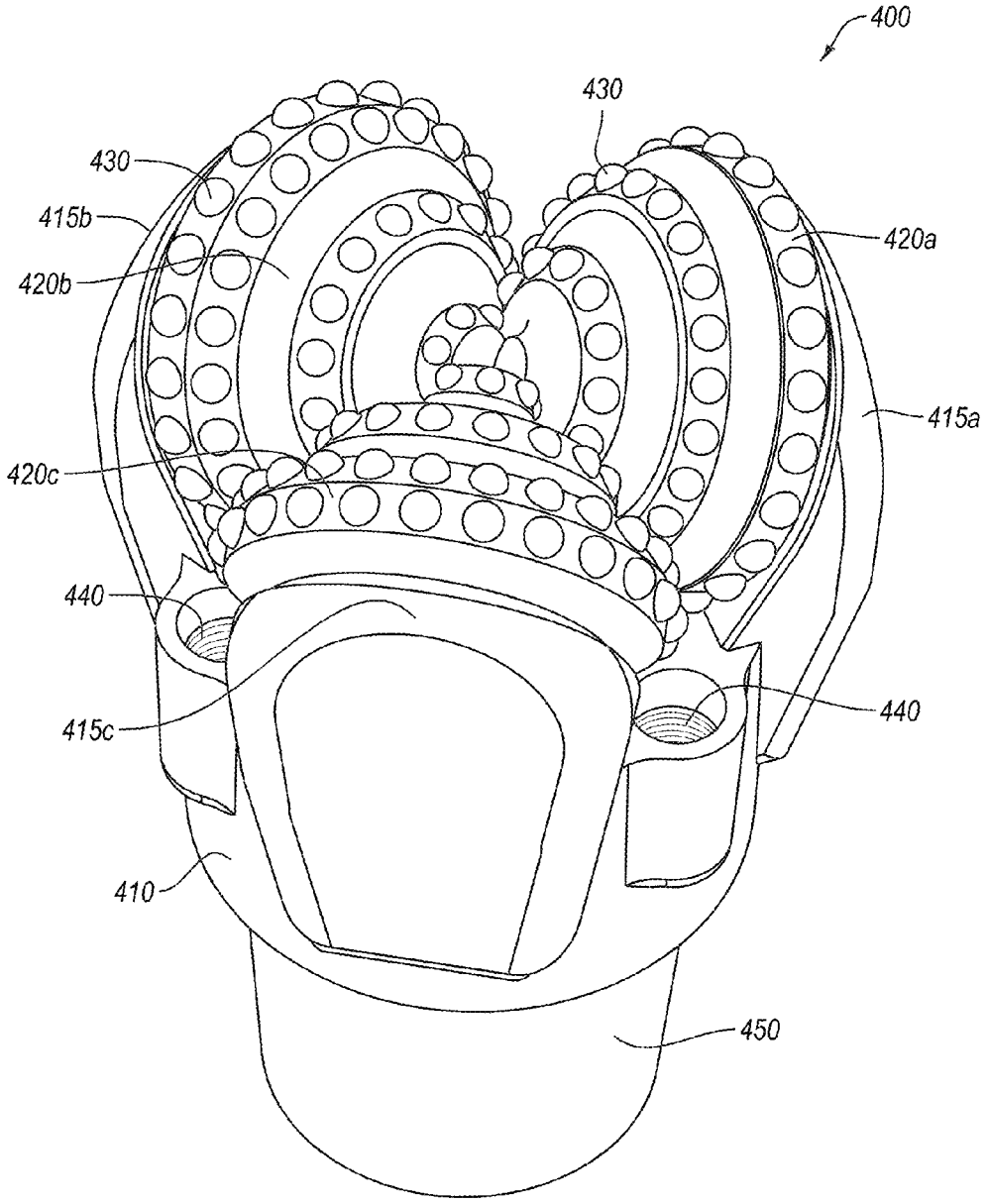
FIG. 4A is an isometric view of a roller cone bit that may include one or more of the DEC cutting elements described herein.

FIG. 4A is an isometric view of a roller cone drill bit 400 that may include one or more of any of the DEC cutting elements described herein. The drill bit 400 includes a bit body 410 that may be made from steel or a carbide material suitable for use in roller cone bit bodies. The bit body 410 includes one or more legs, and typically includes three such legs 415*a*-415*c*, depending from the bit body 410. Each of the legs 415*a*-415*c* includes a corresponding roller cone 420*a*-420*c* rotatably mounted thereon. Each of the roller cones 420*a*-420*c* may be made from steel, a carbide material, or another suitable material. The roller cones 420*a*-420*c* include thereon at selected positions, a plurality of DEC cutting elements 430 that are brazed to or press fit with corresponding roller cones 420*a*-420*c*. For example, some or all of the DEC cutting elements 430 may be configured according to any of the DEC cutting element embodiments disclosed herein. The drill bit 400 also includes ports 440 in the bit body 410 for abrasive drilling fluid (e.g., drilling mud) to be output. The bit body 410 includes an end portion 450 that is configured for connection to a drill string. For example, end portion 450 may include a male or female threaded portion (not shown) that is configured to be threaded onto the drill string.

The drill bit 400 made according to one or more embodiments of the invention is more effective for drilling the DEC cutting elements 430 are more durable and wear resistant, which may increase the service life. The roller cone drill bit 400 is discussed for illustration purposes only. The DEC cutting elements described herein may also be used in mining bits, road bits, hammer bits, and other drilling operations and tools where any of steel, carbide, or PDC cutters are presently used.

Figure 4B:
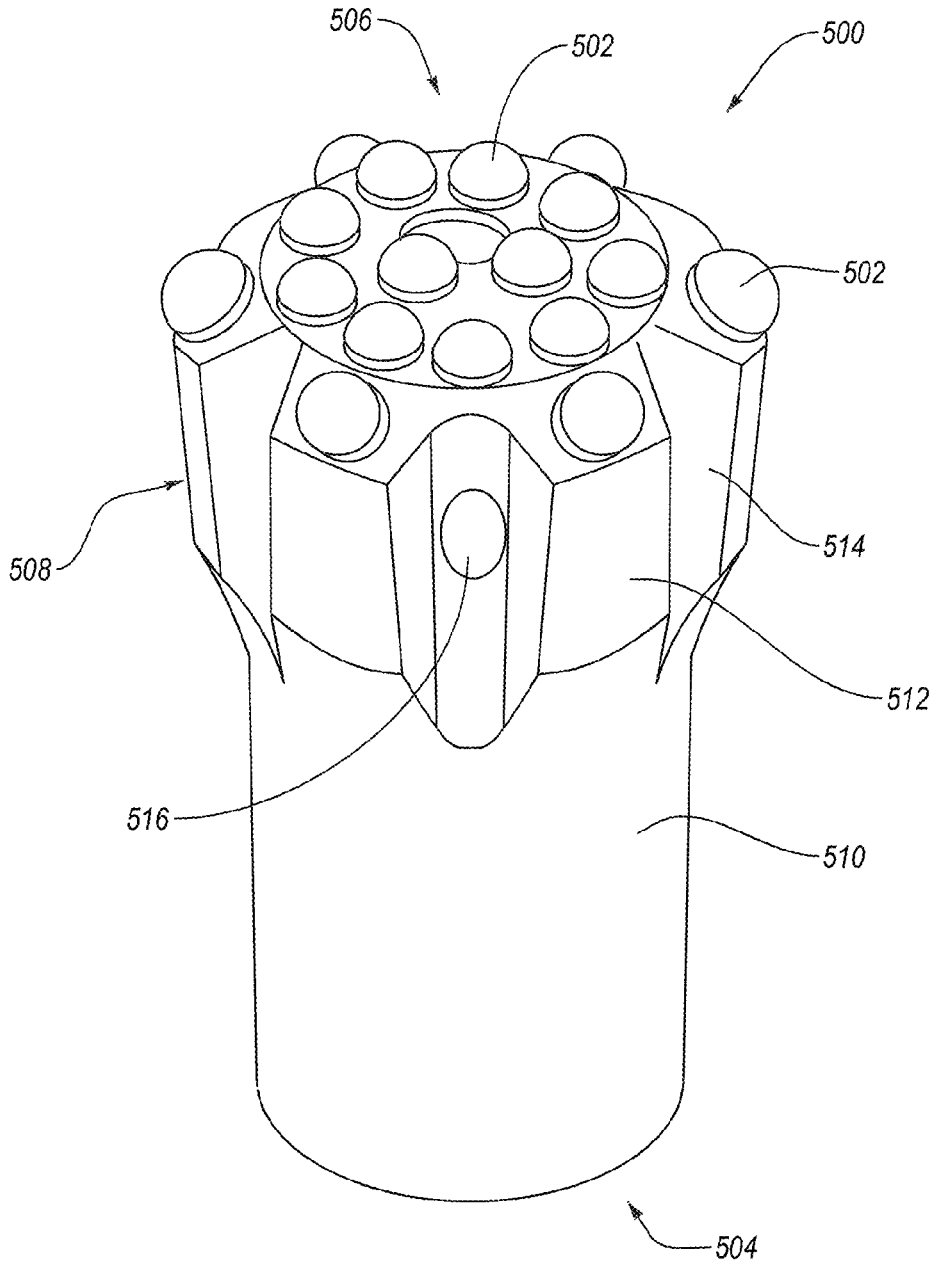
FIG. 4B is an isometric view of an embodiment of a percussive subterranean drill bit including at least one DEC cutting element that may be configured according to any of the DEC cutting elements disclosed herein.

For example, FIG. 4B is an isometric view of an embodiment of a percussive subterranean drill bit 500 including at least one DEC cutting element 502 that may be configured according to any of the DEC cutting elements disclosed herein. The drill bit 500 may be configured at a connection end 504 for connection into a drill string. A percussion face 506 at a generally opposite end (relative to connection end 504) of drill bit 500 is provided with a plurality of DEC cutting elements 502, arranged about percussion face 506 to effect drilling into a subterranean formation as the drill bit 500 is rotated and axially oscillated in a borehole. In an embodiment, a plurality of extending blades 508 may extend or protrude from the bit body 510 of the drill bit 500. A gage surface 512 (also known as a gage pad) may extend upwardly from the percussion face 506 (e.g., from each of the blades 508) and may be proximate to and may contact the sidewall of the borehole during drilling operation of the drill bit 500. A plurality of channels or grooves 514 (also known as "junk slots") extend generally from percussion face 506 to provide a clearance area for formation and removal of chips formed by the DEC cutting elements 502. During use, a drilling fluid (e.g., compressed air, air and water mixtures, or other drilling fluids) may be flowed through a bore (not shown) formed in the bit body 510 and into at least one channel (not shown) of the bit body 510 for output from an opening 516 of the bit body 510. The plurality of DEC cutting elements 502 may each be affixed to (e.g., by press fitting, brazing, etc.) the bit body 510 and may be positioned within recesses formed in the bit body 510. Thus, such DEC cutting elements 502 may provide the ability to actively remove formation material from a borehole.

In an embodiment, a method of making a DEC cutting element is disclosed. The method includes providing a substrate having a proximal portion and a distal portion, and a volume of a carbide powder (e.g., cobalt-cemented tungsten carbide particles) intermixed with a plurality of diamond particles positioned adjacent to the distal portion, and at least partially surrounding the substrate and the volume of the carbide powder/diamond particles within a refractory metal can assembly. The refractory metal can assembly containing the substrate and the volume of the carbide powder/diamond particles is then exposed to an HPHT process to form a sintered DEC layer that is bonded to at least the distal portion of the substrate, with the refractory metal can assembly in turn bonded to the DEC layer and the substrate. During the HPHT process, a constituent from the substrate (e.g., cobalt from a cobalt-cemented tungsten carbide substrate) may infiltrate into the volume of the carbide powder/diamond particles and form a metallurgical bond between the substrate and the DEC layer so formed.

In an embodiment, the method further includes removing a portion of the refractory metal can assembly from at least the proximal portion of the substrate such that at least a portion of the refractory metal can assembly remains bonded to at least part of the DEC layer and/or the distal portion of the substrate as a refractory metal structure. For example, the refractory metal can assembly may be removed (e.g., by blasting, grinding, or machining) from the bottom and sides of the cutter assembly such that the remaining portion of the refractory metal can assembly is bonded to the DEC layer and optionally the distal portion of the substrate. For example, a sufficient amount of the refractory metal can assembly may be removed from the cutter assembly in order to allow the cutter assembly to be inserted into and bonded to a roller cone assembly of a roller cone bit via brazing or press-fitting. In an embodiment, a portion of the refractory metal can assembly may be removed from a tip or edge of the DEC layer. In any of the embodiments disclosed herein, blasting of the refractory metal can assembly with an abrasive media (e.g., silicon carbide and/or alumina) may be used to remove at least a portion of such refractory metal can assembly. In another embodiment, substantially all of the refractory metal can assembly may be removed from the substrate and the DEC layer.

As will be explained in greater detail below in reference to the working and comparative examples, leaving at least a portion of the refractory metal can assembly affixed to the DEC layer increases the useful life of the diamond enhanced carbide cutters disclosed herein, as compared to PDCs and DEC cutters that do not include the refractory metal can assembly remaining thereon.

The diamond particle size distribution of the plurality of diamond particles used in the fabrication of the DEC layer may exhibit a single mode, or may be a bimodal or greater grain size distribution. In an embodiment, the diamond particles may comprise a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger average particle size (e.g., 50 μm, 40 μm, 30 μm, 20 μm, 15 μm, 12 μm, 10 μm, 8 μm) and another portion exhibiting at least one relatively smaller average particle size (e.g., 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger average particle size between about 10 μm and about 40 μm and another portion exhibiting a relatively smaller average particle size between about 1 μm and 4 μm. In some embodiments, the diamond particles may comprise three or more different average particle sizes (e.g., one relatively larger average particle size and two or more relatively smaller average particle sizes), without limitation.

The refractory metal can assembly containing the substrate and the volume of the carbide powder/diamond particles may be subjected to an HPHT process using an HPHT press using diamond-stable HPHT conditions. For example, the HPHT process may be effected at a temperature of at least about 1000° C. (e.g., about 1300° C. to about 1600° C.) and a cell pressure of at least 4 GPa (e.g., about 5 GPa to about 10 GPa, about 7 GPa to about 9 GPa) for a time sufficient to sinter the mixture of the carbide powder and diamond particles to form the DEC layer that bonds to the substrate during cooling from the HPHT process. During the HPHT process, the volume of carbide powder/diamond particles is sintered without substantial graphitization of the plurality of diamond particles due to the diamond-stable HPHT conditions.

In an embodiment, the volume of carbide powder/diamond particles and at least a portion of a substrate are positioned in the refractory metal can assembly and subjected to the HPHT process in a non-inert environment, such as air or other impurities. In another embodiment, the volume of carbide and diamond particles and at least a portion of a substrate may be substantially sealed, in an inert environment, within the refractory metal can assembly and subsequently subjected to an HPHT process. Generally, any methods or apparatuses may be employed for sealing, in an inert environment, the volume of carbide and diamond particles and at least a portion of a substrate within the refractory metal can assembly. For example, methods and apparatuses for sealing an enclosure in an inert environment are disclosed in U.S. Pat. No. 8,236,074, the disclosure of which is incorporated herein, in its entirety, by reference.

In an embodiment, the method of making a cutting element disclosed herein may include forming the DEC layer on a substrate and leaching the DEC layer (e.g., by acid leaching or other technique) to remove a metallic material from the DEC layer. For example, in embodiments in which some of the DEC layer is exposed, at least some of the cobalt from cemented tungsten carbide constituent may be removed by acid leaching to a selected depth. Such a leached DEC layer may have better thermal stability than an unleached DEC layer. In another embodiment, the DEC layer may be removed from a first substrate (e.g., by grinding), either before or after leaching. In an embodiment, the so-obtained preformed DEC layer may be positioned in a refractory metal can assembly with a new substrate and bonded to the substrate in a second HPHT process or a non-HPHT process such as brazing, which may be performed at a lower pressure than used to initial form the DEC layer.

Working and Comparative Examples

Typically, crack resistance and abrasion resistance of DEC cutters may be assessed with a number of tests. For example, the drop impact test evaluates the impact strength of the DEC cutters. This test emulates the type of loading that might be encountered when the bit transitions from one formation to another or experiences lateral and axial vibrations. An abrasion test involves cutting granite and comparing the amount of DEC cutter wear to the amount of granite cut. Typically, several thousand times (e.g., about 20,000 to about 200,000) more granite than DEC cutter wears away in such a test. Information from this test allows the engineers to tailor the abrasion resistance characteristics of the DEC cutters to the needs of specific applications.

In this case, a hybrid test called a "dog collar" test was used that combines elements of both impact and abrasion testing. In the dog collar test, a steel ring having a plurality of circumferentially-spaced cutting inserts mounted thereto is used to simulate the cutting action of a roller cone bit. A disk of rock made from granite was rotated and the dog collar was rotated and moved inwardly from an outer edge of the disk to an inside of the disk which defines a single pass. Passes were repeated with the dog collar cutting the disk. The cutting inserts were regularly examined to determine if any of them failed. Delamination of a DEC layer or a PCD table from a substrate is a common failure mode and is indicated in FIG. 5 as delamination along with the particular cutting insert number of dog collar that failed.

Figure 5:
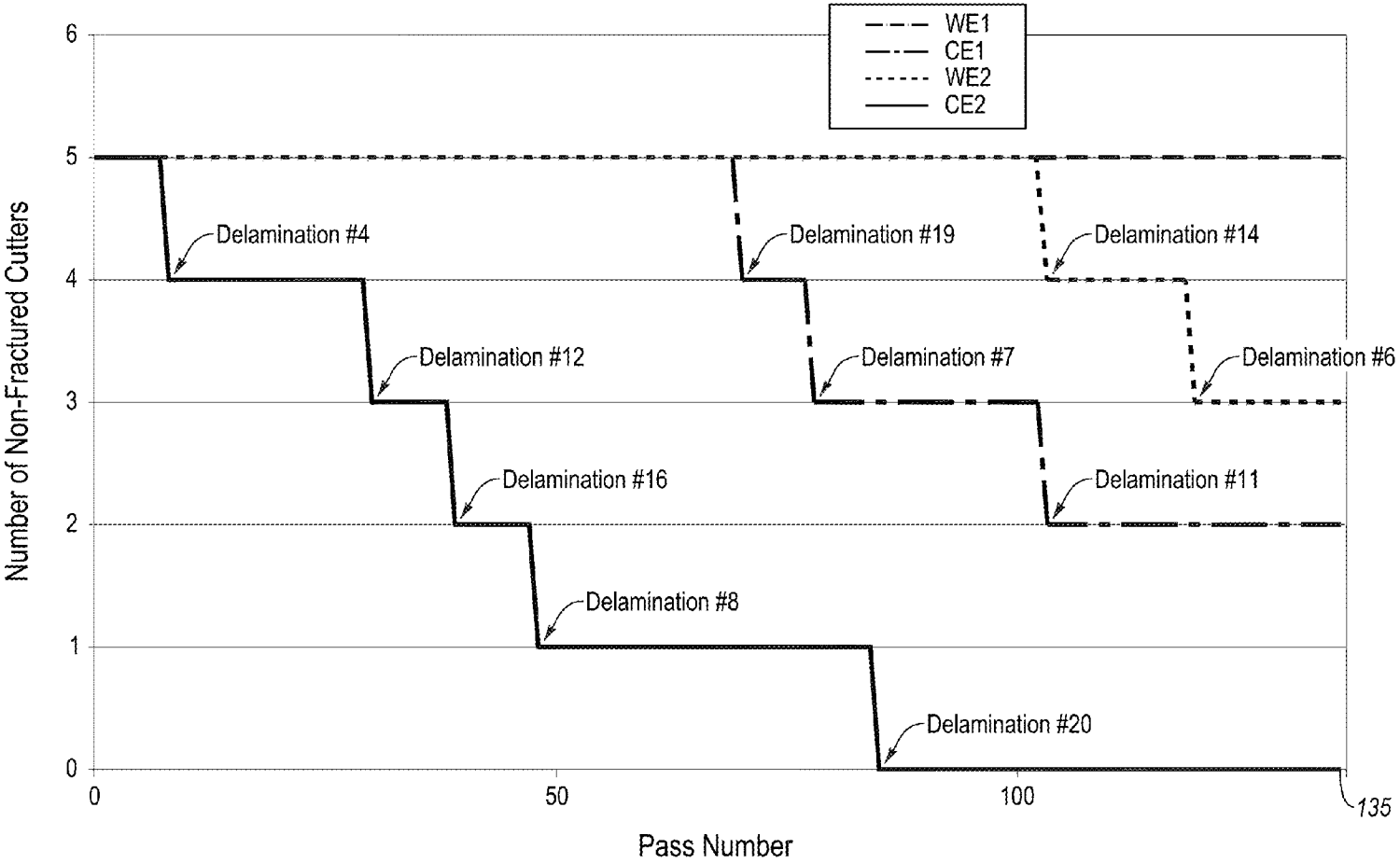
FIG. 5 is a graph of test data comparing a number of differently configured DEC cutting elements to standard PDC cutting elements.

FIG. 5 illustrates test data comparing a number of differently configured DEC cutting elements along with a standard PDC cutting element. In a working example of the invention (labeled WE 1), DEC cutters were made according to an embodiment of the invention. In WE 1, the refractory metal can assembly was removed from the DEC cutters via aggressive abrasive blasting. In WE 2, the refractory metal can assembly was left attached to the DEC layers, but a portion of the refractory metal can assembly was ground away from a tip of the DEC cutter as shown, for example, in FIG. 2D.

In a first comparative example (labeled CE 1), DEC cutters were prepared as above except that the refractory metal can assembly was entirely removed from the cutter by grinding and the DEC layers were polished. In a second comparative example (labeled CE 2), standard PDC cutters (i.e., polycrystalline diamond compact cutters having a polycrystalline diamond table bonded to a cobalt-cemented tungsten carbide substrate) were prepared. It should be noted that the DEC cutters of WE 1, WE 2, and CE 1 all were domed cutters using the same DEC formulation that were sintered under the same HPHT conditions to bond the DEC layer to a cobalt-cemented tungsten carbide substrate.

As shown in FIG. 5, the cutters of WE 1 and WE 2 had a much longer useful life than the cutters of CE 1 and CE 2. For example, no cutters in WE 1 failed even after approximately 100 passes and only two cutters of WE 2 failed after 100 passes. In contrast, three of the DEC cutters of CE 1 failed about at or before 100 passes. Four of the five PDC cutters of CE 2 tested failed in less than 50 passes, and the fifth failed at less than 100 passes. The results of the test data are surprising and unexpected, because it was unexpected that the DEC cutter in which the refractory metal can was removed via abrasive blasting would have the greatest useful life and the DEC cutter having the refractory metal can remaining on the domed DEC layer would have the second greatest damage resistance.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A cutting element, comprising:

a substrate having a proximal portion and a distal portion, at least a portion of the substrate forms an exterior surface of the cutting element;

a sintered diamond-enhanced carbide ("DEC") layer bonded to the distal portion of the substrate, the DEC layer including a plurality of diamond grains distributed in a cemented tungsten carbide constituent; and a refractory metal structure bonded to at least part of the DEC layer;

wherein the cutting element includes an upper surface including at least one surface of the refractory metal structure and at least one surface of the DEC layer.

2. The cutting element of claim 1 wherein the DEC layer includes about 10 volume % to about 90 volume % diamond grains.

3. The cutting element of claim 1 wherein the DEC layer includes about 20 volume % to about 50 volume % diamond grains.

4. The cutting element of claim 1 wherein the DEC layer includes about 25 volume % to about 35 volume % diamond grains.

5. The cutting element of claim 1 wherein the refractory metal structure includes at least one refractory metal selected from the group consisting of niobium, tantalum, molybdenum, titanium, zirconium, and rhenium.

6. The cutting element of claim 1 wherein the cutting element exhibits greater toughness in a dog collar test as compared to a similarly configured cutting element have the refractory metal structure removed from the DEC layer.

7. The cutting element of claim 1 wherein the refractory metal structure is further bonded to a portion of the substrate.

8. The cutting element of claim 1 wherein the DEC layer has a thickness in a range of about 0.020 inch to about 0.080 inch.

9. The cutting element of claim 1 wherein the DEC layer has a thickness of about 0.0275 inch to about 0.040 inch.

10. The cutting element of claim 1 wherein the DEC layer exhibits a substantially uniform or non-uniform thickness.

11. A drilling apparatus, comprising:

a bit body; and one or more cutting elements attached to the bit body, the one or more cutting elements including:

a substrate having a proximal portion and a distal portion, at least a portion of the substrate forms an exterior surface;

a sintered diamond-enhanced carbide ("DEC") layer bonded to the distal portion of the substrate, the DEC layer including a plurality of diamond grains distributed in a cemented tungsten carbide constituent; and a refractory metal structure bonded to at least part of the DEC layer;

wherein the cutting element includes an upper surface including at least one surface of the refractory metal structure and at least one surface of the DEC layer.

12. The drilling apparatus of claim 11 wherein the one or more cutting elements are press fit with or brazed to the bit body.

13. The drilling apparatus of claim 11 wherein the DEC layer includes about 25 volume % to about 35 volume % diamond grains.

14. The drilling apparatus of claim 11 wherein the refractory metal structure includes at least one refractory metal selected from the group consisting of niobium, tantalum, molybdenum, and rhenium.

15. The drilling apparatus of claim 11 wherein the refractory metal structure is further bonded to a portion of the substrate.

16. The drilling apparatus of claim 11 wherein the DEC layer has a thickness of about 0.0275 inch to about 0.040 inch.

17. The drilling apparatus of claim 11 wherein the bit body includes a plurality of roller cones on which the one or more cutting elements are mounted.

18. A method of making a cutting element, comprising:

providing a substrate having a proximal portion and a distal portion, and a volume of a carbide powder, wherein the carbide powder is intermixed with a plurality of diamond particles;

completely surrounding the substrate and the volume of the carbide powder within a refractory metal can assembly;

exposing the refractory metal can assembly containing the substrate and the volume of the carbide powder to a high-pressure, high-temperature ("HPHT") process to form a sintered diamond-enhanced carbide ("DEC") layer that is bonded to at least the distal portion of the substrate; and removing a portion of the refractory metal can assembly from at least the proximal portion of the substrate such that at least a portion of the refractory metal can assembly remains bonded to at least part of the DEC layer.

19. The method of claim 18 wherein the carbide powder includes cobalt-cemented tungsten carbide particles and the plurality of diamond particles.

20. The method of claim 18 wherein the carbide powder includes about 25 volume % to about 35 volume % diamond particles.

21. The method of claim 18 wherein the DEC layer includes about 25 volume % to about 35 volume % diamond grains.

22. The method of claim 18 wherein the refractory metal can assembly includes a refractory metal can assembly that substantially surrounds the substrate and the volume of the carbide powder, and wherein the refractory metal can assembly is fabricated from at least one refractory metal selected from the group consisting of niobium, tantalum, molybdenum, and rhenium.

23. The method of claim 18 wherein the DEC layer has a thickness of about 0.0275 inch to about 0.040 inch.

24. The method of claim 18 wherein removing a portion of the refractory metal can assembly from at least the proximal portion of the substrate such that at least a portion of the refractory metal can assembly remains bonded to at least part of the DEC layer includes removing the portion by grinding, abrasive blasting, machining, or combinations thereof.

25. A method of making a cutting element, comprising:

providing a substrate having a proximal portion and a distal portion, and a volume of a carbide powder adjacent to the distal portion, wherein the carbide powder is intermixed with a plurality of diamond particles;

at least partially surrounding the substrate and the volume of the carbide powder within a refractory metal can assembly;

exposing the refractory metal can assembly containing the substrate and the volume of the carbide powder to a high-pressure, high-temperature process to form a sintered diamond-enhanced carbide ("DEC") layer that is bonded to at least the distal portion of the substrate; and blasting the refractory metal can assembly with an abrasive media to remove substantially all of the refractory metal can assembly from the substrate and the DEC layer.

* * * * *